US005109643A

United States Patent [19]

Speers

[11] Patent Number: 5,109,643

[45] Date of Patent: May 5, 1992

[54] OVERHANGING STRUCTURE

[76] Inventor: George A. Speers, 9478 Francis Rd., DeWitt, Mich. 48820

[21] Appl. No.: 564,088

[22] Filed: Aug. 8, 1990

[51] Int. Cl.[5] ..... E04B 7/04

[52] U.S. Cl. ..... 52/90; 52/28; 52/221; 52/463

[58] Field of Search ..... 52/73, 28, 221, 95, 52/463, 464, 94, 75, 76, 90

[56] References Cited

U.S. PATENT DOCUMENTS

| | | | |
|---|---|---|---|
| 263,354 | 8/1882 | Rew . | |
| 3,092,171 | 6/1963 | Deddo | 52/78 |
| 3,113,434 | 10/1963 | Phillips et al. . | |
| 3,234,697 | 2/1966 | Toti | 52/75 |
| 3,286,404 | 11/1966 | Harrison . | |
| 3,302,342 | 2/1967 | Castleberry . | |
| 3,332,179 | 9/1967 | Toti . | |
| 3,381,423 | 5/1968 | Feld | 52/78 |
| 3,574,985 | 4/1971 | Pierce | 52/463 |
| 4,411,109 | 10/1983 | Struben et al. . | |
| 4,480,417 | 11/1984 | Evers . | |
| 4,765,102 | 8/1988 | Kuchem . | |
| 4,796,391 | 1/1989 | Lu . | |

*Primary Examiner*—John E. Murtagh
*Attorney, Agent, or Firm*—Ian C. McLeod

[57] ABSTRACT

A roof channel member (12) for securing roof panels (16) in a channel-braced awning structure (10) is described. The roof channel member is formed from a bottom plate (20) which provides for a female securing post (24) and an upper plate (21) with a male arrow tab (27) for mating with the securing post. A plurality of roof channel members secure side-by-side roof panels in a frame formed from a first F-channel cross member or wall bracket (11), an opposed second F-channel cross member (14), and two parallel spaced apart F-channel side member (13) which join the wall bracket and the second F-channel cross member at the ends. Openings (32) at intervals along the length of the bottom plate provide for light bulbs (34) which mounts into light sockets (33) fitted through the openings. Spaced apart channels (28, 29) on opposed sides of the securing post provide for electrical wires (40) to power the light bulbs. The awning structure is supported off the ground by column members (**15*a*, 15*b***).

11 Claims, 3 Drawing Sheets

OVERHANGING STRUCTURE

Figure 1:
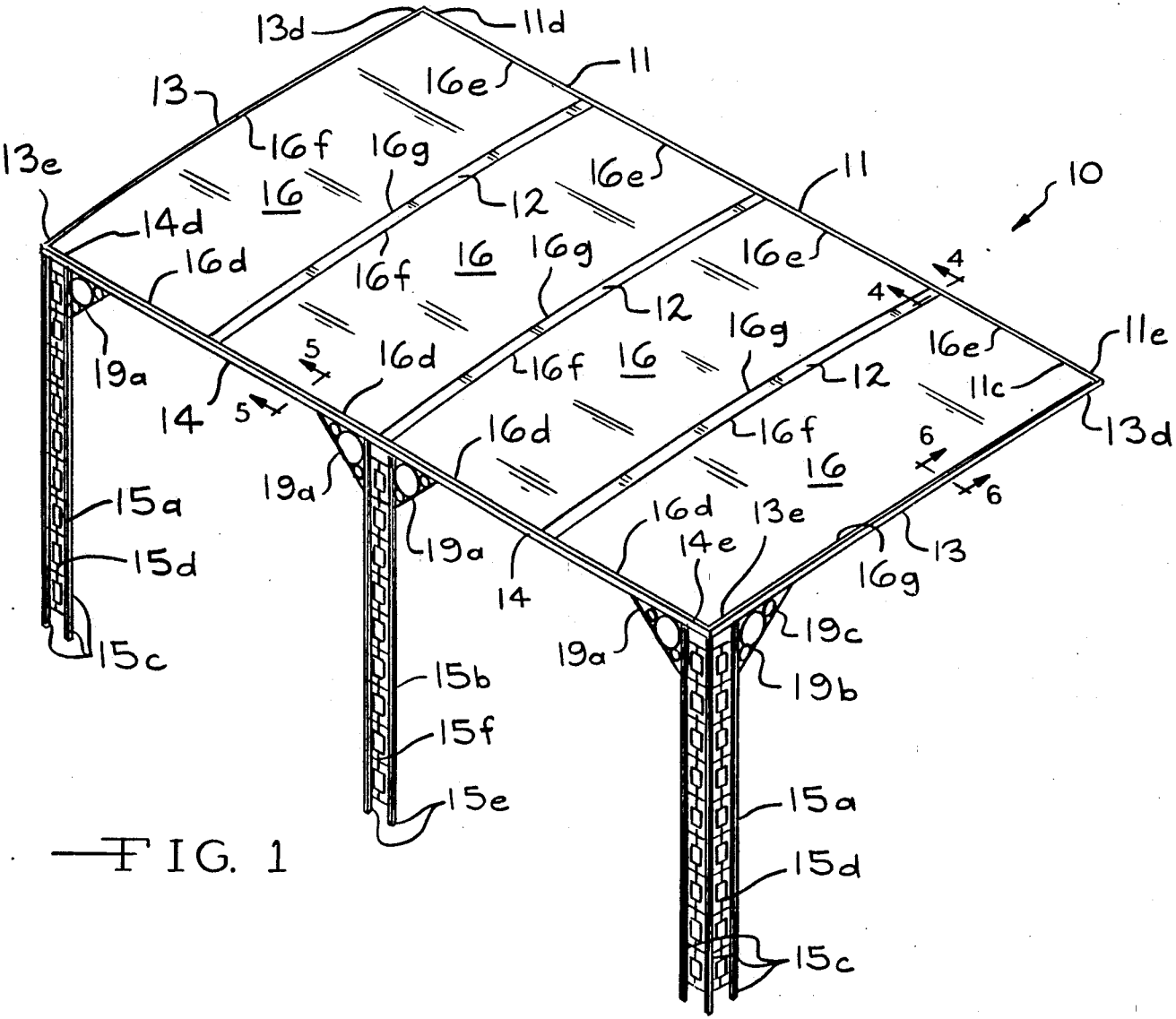

BACKGROUND OF THE INVENTION (1) Field of the Invention

The present invention relates to an overhang structure or awning structure that is particularly adaptable for use as a carport. In particular, the present invention relates to a structure with a uniquely constructed roof channel member that secures the roof panels of the awning structure. The channel member of the present invention preferably has a horizontally oriented H-shaped cross-section, and the channel member consists of an upper plate member and a lower plate member with mating male and female securing members joining them together. Provision is made for electrically wiring the channel members.

(2) Prior Art

The prior art has described various types of support structures for awnings or canopies that mount on the outside of a building or a house trailer in either a temporary or permanent construction. The primary purpose of these structures is to provide a covered living space that is both outside of the immediate confines of the host structure and which is protected from the weather elements. Some of the awning structures are permanently mounted in an unfolded or set-up position. Other awning structures, however, are designed to hinge from the side of the host structure between an unfolded, set-up position with support columns at the outer edges of the awning and a folded or collapsed position with the supports columns removed and the awning secured adjacent to the host structure. The folded position is necessary when there is severe weather that could possibly damage the awning structure if it were left unfolded during the storm or when the host stucture is a mobile home that is being moved on a highway. Illustrative of the prior art support structures are U.S. Pat. No. 263,354 to Rew; U.S. Pat. No. 3,113,434 to Phillips et al; U.S. Pat. No. 3,302,342 to Castleberry; U.S. Pat. No. 3,286,404 to Harrison; U.S. Pat. No. 3,332,179 to Toti; U.S. Pat. No. 4,411,109 to Struben et al; U.S. Pat. No. 4,480,417 to Evers; U.S. Pat. No. 4,765,102 to Kuchem; and U.S. Pat. No. 4,796,391 to Lu.

Rew describes the construction of a building that is built from translucent panels set in cells of a suitable frame where the free admission of light into the building is desired.

Phillips et al describes a modular panel unit adapted for use in the construction of roof decks, awnings, wing break panels, and other similar structures that embodies a sheet of a translucent corrugated plastic material, such as fiberglass.

Castleberry describes an awning type roof structure for mobile homes that is constructed from a number of identically fabricated roof sections. The roof sections include a frame of angle iron side members and angle iron front and rear members that receive a corrugated roof panel. The roof sections are bolted and welded together and supported by front supports and back supports. The roof structure is not secured to the side of the mobile home, but instead rests against the host structure with an intermediate gasket sealing between the roof structure and the mobile home.

Harrison describes a metal awning for a mobile home that consists of a frame that provides for a plurality of interlocking roof panels. The awning is hinged from the outside wall of the mobile home and supported at the front end by support columns.

Toti describes a canopy structure that has a series of overlapping cover panels that interlock with the structural units of the supporting framework. The canopy structure is rigidly mounted to the host structure and supported by columns at the front end of the canopy.

Struben et al describes a rigid beam-braced awning structure that is attached to the outside wall of a building. The awning structure has a plurality of main I-beams that extend between an outer beam member and a channel member that is bolted to the host structure. Pan (panel) members are fitted between each pair of adjacent main I-beams so that two side-by-side pan members with an intermediate main I-beam can be bolted together. This process is repeated until the roof proper of the awning structure is constructed. The rigid awning structure is supported at the front by column supports.

Lu describes a complicated overhang structure that consists of a number of posts, a front beam, a rear beam, a number of rafters, a number of auxiliary poles, two fascias, and a number of struts which are bolted together and completed with roof sheathing.

Kuchem describes a building panel support member which provides for a lighting system. The building panels are bolted edge to edge on one end of the support member. A channel formed in the opposite end of the support member provides for an elongated glass light bulb which is held in place with a special clip.

Evers discloses a glass pane framed by a U-shaped clamping rail wherein a group of raised bodies are anchored into the surface of the glass pane. The raised bodies press themselves into a layer of elastic deformable material between the glass pane and the clamping rail when the clamping rail is clamped onto the glass pane, thereby increasing the adhesion of the glass pane to the clamping rail.

The problem with the prior art awning or canopy structures is that they are all relatively difficult to construct. Also, none of the prior art structures provides for a lighting system as a part of the channel member.

OBJECTS

It is therefore an object of the present invention to provide an awning structure with an improved channel member for securing the roof panels of the awning structure in place wherein the roof channel member is formed of a separable bottom plate and an upper plate mated together through a unique securing system. Further, it is an object of the present invention to provide a preferred securing system for the bottom and upper plates wherein the plates have a securing means which snaps together. Further, it is an object of the present invention to provide a unique channel member which provides for electrical wires that connect to light bulbs which snap into light sockets provided at intervals in the bottom plate. Still further, it is an object of the present invention to provide a unique securing system for the bottom and upper plates of a roof channel that is simple and inexpensive to construct and which is easy to assemble between the side-by-side roof panels of an awning structure. These and other objects will become increasingly apparent to those skilled in the art and by reference to the drawings.

IN THE DRAWINGS

FIG. 1 is a left side perspective view of a channel-braced awning structure 10 particularly showing a first F-channel cross member or wall bracket 11, two F-channel side members 13, a second F-channel cross member 14 and three roof channel members 12 all of which are framing in four roof panels 16 and which are supported off the ground by column members 15*a* and 15*b*.

Figure 2:
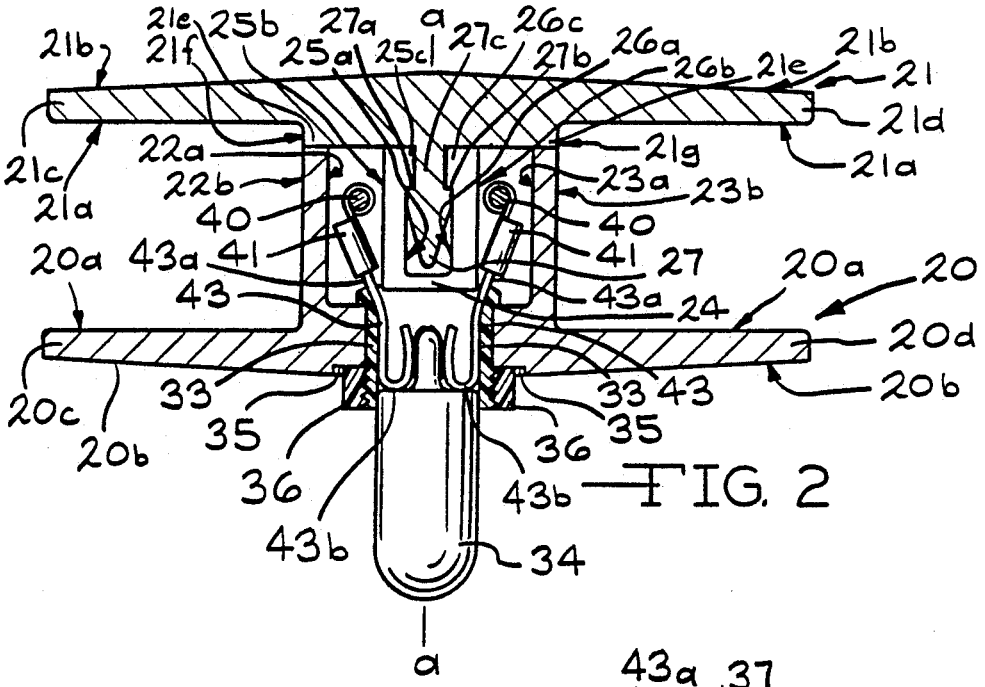

FIG. 2 is a cross-sectional view of a roof channel member 12 particularly showing a top plate 21 secured to a bottom plate 20 by arrow tab 27 snapped into securing post 24 along with light bulb 34 fitted into light socket 33 and connected to electrical wires 40 with electrical connectors 41 and J-shaped electrical connectors 43.

Figure 3:
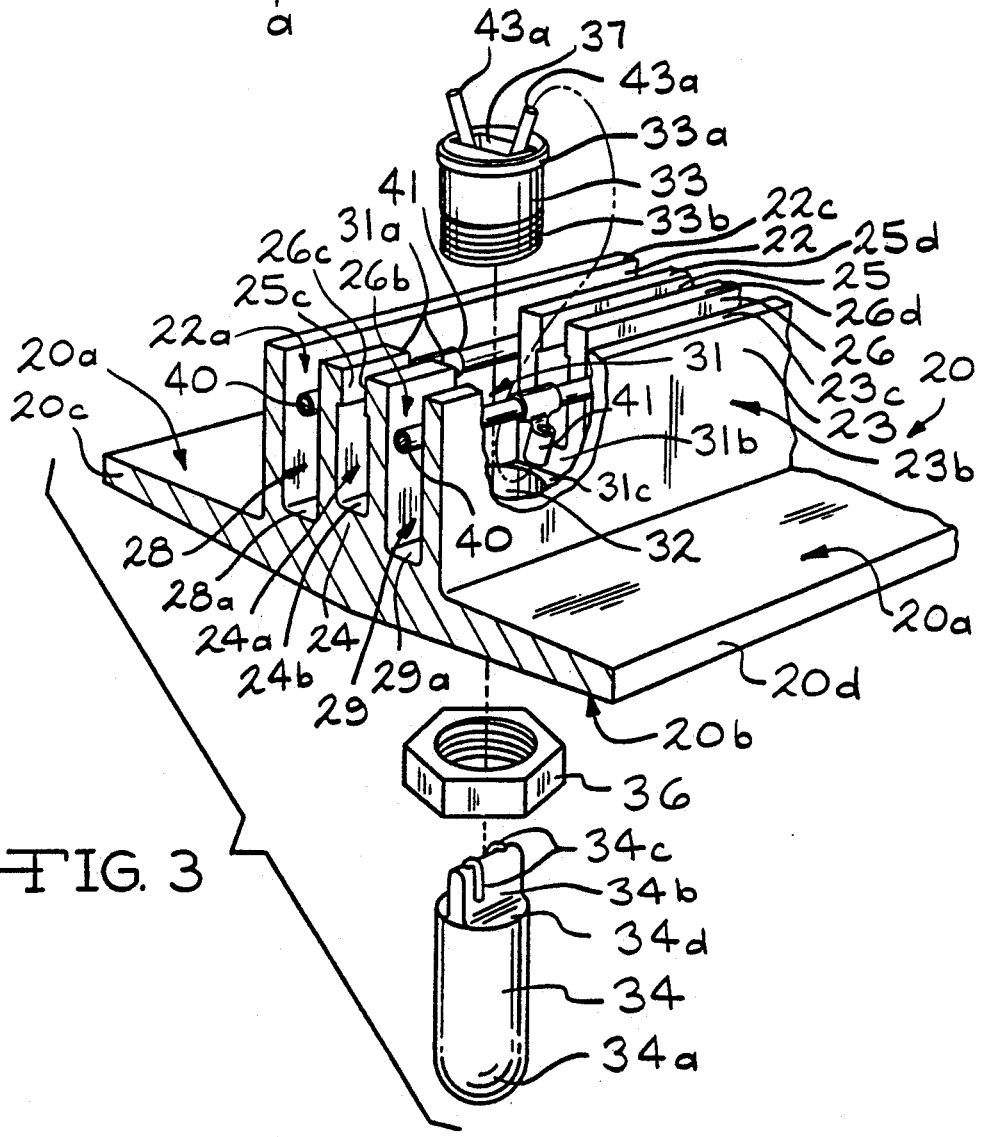

FIG. 3 is a separated perspective view showing the positioning of the light bulb 34 in the light socket 33 secured in opening 32 through recess 31 by nut 36 and showing the J-shaped electrical connectors 43 connected to the electrical wires 40 through electrical connector 41.

Figure 4:
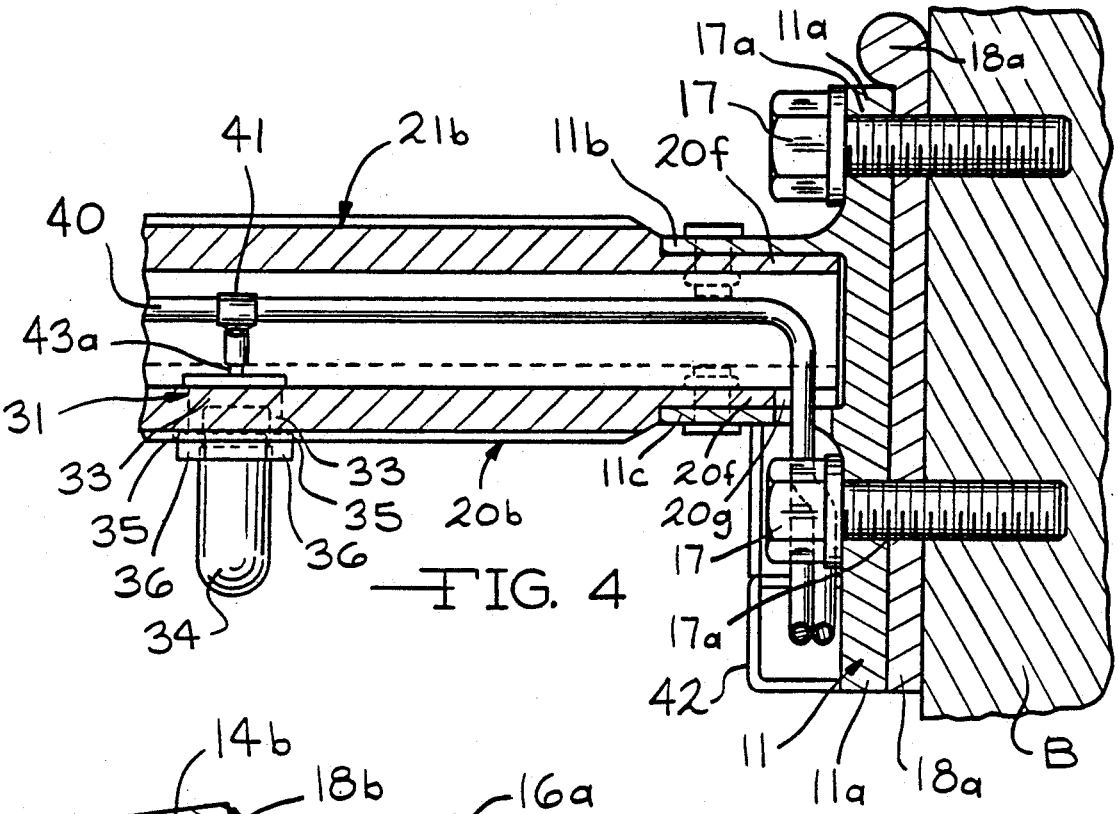

FIG. 4 is a right side view along line 4—4 of FIG. 1 showing the roof channel member 12 positioned in the wall bracket 11 which is bolted to the outside wall of the building B with intermediate sealing gasket 18*a*.

Figure 5:
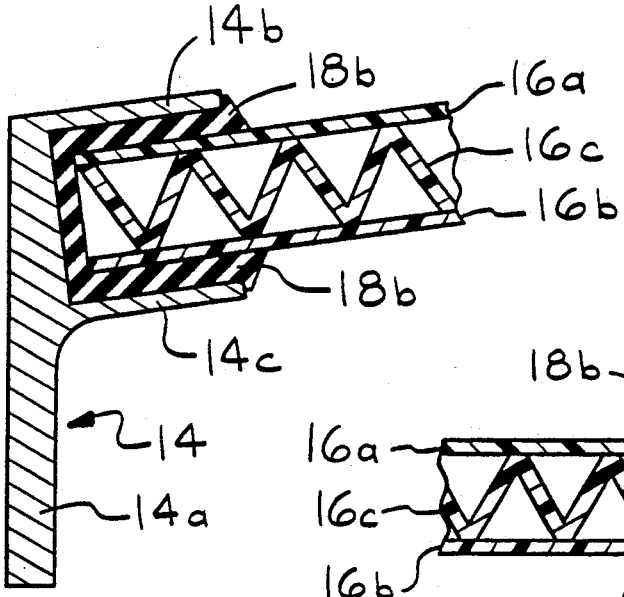

FIG. 5 is a cross-sectional view along line 5—5 of FIG. 1 showing the F-channel cross member 14 and the roof panel 16 with intermediate seal 18*b*.

Figure 6:
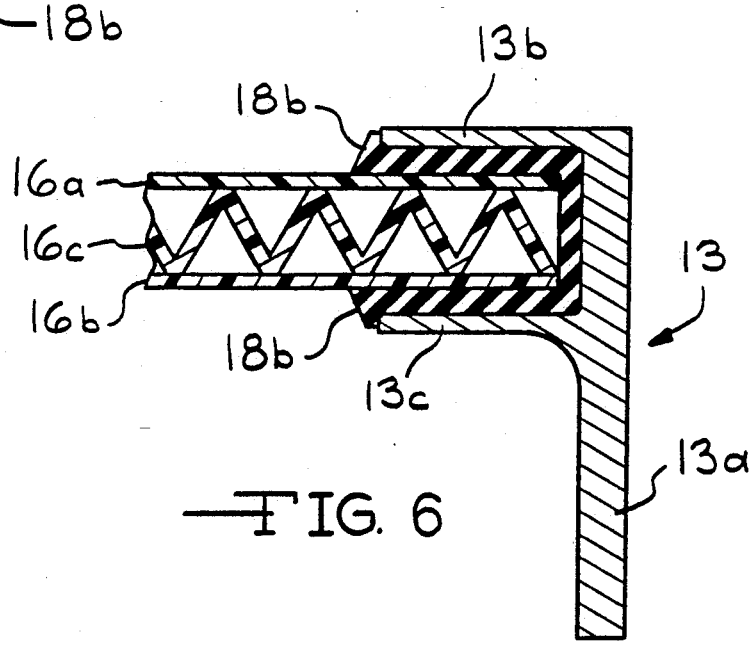

FIG. 6 is a cross-sectional view along line 6—6 of FIG. 1 showing the F-channel side member 13 and the roof panel 16 with intermediate seal 18*b*.

GENERAL DESCRIPTION

An overhang structure which mounts on an outside of a building including a roof panel support provided by multiple spaced apart parallel roof channel members having opposed ends and which roof channel members extend away from the building, F-channel side members at opposed sides of the roof panel support and parallel to the roof channel members, a first F-channel cross member which mounts on an outside wall of the building at one of the ends of the channel members and connecting the F-channel side member and a second F-channel cross member which is parallel to the first F-channel cross member and mounted at the other of the ends of the roof channel members and connecting the F-channel side members and including support members which support the roof support, the improvement which comprises: each roof channel member having two spaced apart plates and a securing member between and connecting the plates defining at least one channel along a length of the roof channel member, wherein one of the plates of the roof channel member is separable from the securing member; and securing means for holding the one of the plates of the roof channel member to the securing member, wherein each of the roof channel members supports at least one roof panel along the length of the roof channel member.

Further, the present invention relates to an overhang structure which mounts on an outside of a building including a roof panel support provided by multiple spaced apart parallel roof channel members having opposed ends and which roof channel members extend away from the building, F-channel side members at opposed sides of the roof panel support and parallel to the wall channel member, a first F-channel cross member which mounts on an outside wall of the building at one of the ends of the roof channel members and connecting the F-channel side members, and a second F-channel cross member which is parallel to the first F-channel cross member and mounted at the other of the ends of the roof channel members and connecting the F-channel side members and including support members which support the roof support the improvement which comprises: each roof channel member having two spaced apart plates and securing member between and connecting the plate defining at least one channel along a length of the roof channel member, wherein one of the plates of the roof channel member is separable from the securing member to expose two parallel slots inside and along the length of the securing member with a center post along the length of the securing member between slots, wherein the slots can support separate wires in each slot; and securing means for holding the one of the plate of the roof channel member to the securing member to close the slots, wherein each of the roof channel members supports at least one roof panel along the length of the roof channel member.

The wall bracket, F-channels, and roof channels of the awning structure are preferably constructed of an aluminum extrusion. The roof panels are preferably made from a polycarbonate translucent plastic extrusion or bonded unit and the weather seals are preferably made of an ethylene propylene rubber. The leg column supports are constructed of one inch square tubing while the brackets are preferably constructed of a welded metal rod finished with baked enamel.

The roof channel members are preferably constructed in a horizontally oriented H-shaped cross-section with spaced apart electrical wire channels on opposed sides of the center securing means. A novel aspect of the preferred roof channel members is that the upper plate can be easily separated from the bottom plate by lifting up on the upper plate, thereby causing the male arrow tab of the upper plate to release from the female securing post of the bottom plate. This exposes the spaced apart electrical wire slots and the snap in light bulb light sockets, so that the electrical wires and the light sockets can be easily changed or replaced. Further, the added thickness of the roof channel members at the plane a-a as compared to the outer edges of the roof channels adds considerable strength to the roof channels so that they are able to support a considerable amount of weight in the form of snow, for instance.

It should be noted that while the roof channels are preferably constructed in a horizontally oriented H-shaped configuration, they can also be constructed in an F-shaped configuration. This would enable the roof channel members to be used as the F-channel side members and F-channel cross members that enclose the outer periphery of the roof proper. The roof channel members can also be made foldable for easy storage. Also, the upper and bottom plates can be secured together by bolts or gluing or any other suitable means, although the male arrow tab and the female securing post construction is the preferred securing means. Furthermore, any number of suitable securing means can be used to secure the ends of the two roof channel side members, the first F-channel cross member or wall bracket and the second F-channel cross member together including welding, riveting and bolting the ends together.

SPECIFIC DESCRIPTION

Referring to the drawings and particularly to FIG. 1, a channel-braced awning structure 10 is shown whose general construction is composed of a first F-channel cross member or wall bracket 11, a plurality of roof channel members 12, spaced apart F-channel side members 13 parallel to the roof channel members 12, a second F-channel cross member 14 parallel to wall bracket member 11, a plurality of column or support members 15*a* and 15*b*, and a plurality of roof panels 16.

As shown in FIG. 1, the column members 15*a* consist of three spaced apart square cross-sectioned rod members 15*c* arranged to form a right angled support with intermediate lattice work 15*d* between the rod members 15*c*. Two column members 15*a* project from the ground spaced from the wall bracket 11 a distance sufficient for a panel member 16 to fit between the wall bracket 11 and the column members 15*a*. Each column member 15*a* is aligned with respect to the wall bracket 11 so that one side of the column member 15*a* faces the wall bracket 11 while the other side is in a plane perpendicular to the wall bracket 11.

The column member 15*b* consists of two spaced apart square cross-sectioned rod members 15*e* with intermediate lattice work 15*f*. The column member 15*b* projects from the ground in a plane that is parallel with and spaced from the wall bracket 11 a distance sufficient for a panel member 16 to fit between the wall bracket 11 and the column member 15*b*. The two column members 15*a* are separated by a distance sufficient to provide for the width of four roof panels 16 with three intermediate roof channel members 12. Column member 15*b* is positioned equidistant between the two column members 15*a*. The column members 15*a* and 15*b* can be erected in either a temporary set-up pending the installation of the awning proper, or they can be permanently installed in the ground before the awning proper is attached to the column members 15*a* and 15*b*.

As shown in FIG. 4, wall bracket member 11 consists of a vertical web member 11*a*, a top flange 11*b*, and a bottom flange 11*c*. Flanges 11*b* and 11*c* are parallel to each other and perpendicular to web member 11*a*. Wall bracket 11 is secured to the outside wall of a building B by bolts 17 through openings 17*a* in web member 11*a* so that flanges 11*b* and 11*c* are between the position of the bolts 17. A sealing gasket 18*a* is inserted between the web member 11*a* of wall bracket 11 and the outside wall of the building B to seal against the weather elements.

An F-channel side member 13 as shown in FIG. 6 is placed between the wall bracket 11 and each column member 15*a*. The F-channel side members 13 consist of a vertical web member 13*a*, a top flange 13*b*, and a bottom flange 13*c*. Flanges 13*b* and 13*c* are parallel to each other and perpendicular to web member 13*a*. The F-channel side members 13 are secured in place by rivets or other suitable fastening means which join the web member 13*a* below the bottom flange 13*c* to the top of the side of the column member 15*a* that is in a plane perpendicular to the wall bracket 11. The distal ends 13*d* of two F-channel side members 13 are secured to the opposed ends 11*d* and 11*e* of the wall bracket 11 (FIG. 1) by rivets or other suitable fastening means, thereby forming a right angle where the two F-channel side members 13 join the wall bracket 11.

An F-channel cross member 14 as shown in FIG. 5 is positioned across the top of the column members 15*a* and 15*b*. The F-channel cross member 14 consists of a vertical web member 14*a*, a top flange 14*b*, and a bottom flange 14*c*. Flanges 14*b* and 14*c* are parallel to each other and aligned at an angle inclined upward from the plane perpendicular to the web member 14*a*. The upward angular incline of flanges 14*b* and 14*c* allows for the run-off of liquid weather when the panels 16 are secured in the F-channel cross members 14 and the wall bracket 11. The F-channel cross member 14 is secured to the column members 15*a* and 15*b* by rivets or other suitable fastening means which join the web member 14*a* below the bottom flange 14*c* to the top of the sides of the two column members 15*a* which are parallel to the wall bracket 11 and to the top of column member 15*b*. Finally, the opposed ends 14*d* and 14*e* of F-channel cross member 14 are secured to the proximal ends 13*e* of the two F-channel side members 13 (FIG. 1) by rivets or other suitable fastening means.

For added support, right-angled triangular brackets 19*a* are positioned at the junction of the column members 15*a* and the F-channel cross member 14 and at the junction of the column member 15*b* and the F-channel cross member 14. A second right angle bracket 19*b* is positioned at the junction of the channel member 15*a* and the F-channel side members 13. Bracket 19*b* is similar to bracket 19*a* except that one side 19*c* of the bracket 19*b* is angled slightly upward in an incline identical to the incline of flanges 14*b* and 14*c* of F-channel cross member 14.

The roof panels 16 consist of two spaced apart plastic sheets 16*a* and 16*b* with intermediate support webs 16*c* in the shape of corrugate as shown in FIGS. 5 and 6. To seal the seam where the roof panels 16 meet the wall bracket 11, the two F-channel side members 13, and the F-channel cross member 14, a U-cross sectioned rubber seal 18*b* as shown in FIGS. 5 and 6, of sufficient length to cover the circumference of a roof panel 16, is fitted into that part of the channel formed by the spaced apart flanges 11*b* and 11*c* extending from the vertical web 11*a* of wall bracket 11, the channel formed by the spaced apart flanges 13*b* and 13*c* extending from the vertical web 13*a* of the two F-channel side members 13, and the channel formed by the spaced apart flanges 14*b* and 14*c* extending from the vertical web 14 of F-channel cross member 14 that will be occupied by a single roof panel 16. The roof panels 16 are positioned (FIG. 1) so that the front end 16*d* is between the flanges 14*b* and 14*c* of F-channel cross member 14, the back end 16*e* is between the flanges 11*b* and 11*c* of the wall bracket 11, and the back side 16*f* of the roof panel 16 is adjacent to the flanges 13*c* and 13*b* of F-channel side member 13 with intermediate seal 18*b* covering the front end 16*d*, the back end 16*e*, and the back side 16*f*, of the roof panel 16. The opposed ends of the seal 18*b* are then joined together by a rubber sealing cement at the front side 16*g* of the roof panel 16.

As shown in FIGS. 2 and 3, the roof channel member 12 consists of a bottom plate 20 and an upper plate 21 with an arrow tab 27 formed along the length of the upper plate 21 providing the other half of the preferred securing means for the roof channel 12.

The bottom plate 20 has a horizontal upper surface 20*a* perpendicular to the plane a—a and a lower surface 20*b* which has a slight taper downward and inward toward the plane a—a so that bottom plate 20 is slightly thicker at the plane a—a than it is at its opposed sides 20*c* and 20*d*. Spaced apart vertical webs 22 and 23 extend from the upper surface 20*a* along the length of the bottom plate 20 on opposed sides of and parallel with the plane a—a of the bottom plate 20. Intermediate extending walls 25 and 26 from the securing post 24 which is half of the preferred securing means for the roof channel member 12. The securing post 24 extends along the length of the bottom plate 20 between webs 22 and 23. In this manner, the inside surface 22*a* of web 22 and the outside surface 25*b* of wall 25 form electrical wire channel 28. Similarly, the inside surface 23*a* of web 23 and the outside surface 26*b* of wall 26 form electrical wire channel 29. The base wall 28*a* of channel 28 and the base wall 29*a* of channel 29 are coplanar and perpendicular to the plane a—a of the bottom plate 20, and both walls 28*a* and 29*a* are in a plane spaced above the upper surface 20*a* of the bottom plate 20. Also, the inside surface 25*a* of wall 25 and the inside surface 26*a* of wall 26 form a channel 24*a* in securing post 24 whose base wall 24*b* is in a plane perpendicular with the plane a—a of the bottom plate 20 and spaced above the upper surface 20*a* of the bottom plate 20 and the base walls 28*a* and 29*a* of the electrical conduit channels 28 and 29. Ribs 25*c* and 26*c* extend from the inside surfaces 25*a* and 26*a* adjacent to the upper edges 25*d* and 26*d* of walls 25 and 26 of securing post 24 along the plane a—a of the bottom plate 20. The upper edges 22*c* of web 22, 23*c* of web 23, 25*d* of wall 25, and 26*d* of wall 26 are all coplanar and perpendicular to the plane a—a of the bottom plate 20.

The upper plate 21 has a horizontal lower surface 21*a* which is perpendicular to the plane a—a and an upper surface 21*b* which has a slight taper upward and inward toward the plane a—a so that upper plate 21 is slightly thicker at the plane a—a than it is at its opposed sides 21*c* and 21*d*. An enlarged portion 21*e* depends from the lower surface 21*a* along the longitudinal length of the upper plate 21. An arrow shaped tab 27 which depends from an enlarged portion 21*e* forms the other half of the preferred securing means for the roof channel member 12. The arrow tab 27 has spaced apart ledges 27*a* and 27*b* adjacent to the shaft 27*c* of arrow tab 27. When the upper plate 21 is positioned over the bottom plate 20, the arrow tab 27 snaps into channel 24*a* in the securing post 24. The arrow tab 27 is secured in place when ribs 25*c* and 26*c* of walls 25 and 26 of securing post 24 are positioned adjacent to ledges 27*a* and 27*b* of the arrow tab 27. In this position, the outside edges 21*f* and 21*g* of enlarged portion 21*e* are planar with the outside walls 22*b* and 23*b* of webs 22 and 23.

A rectangular cross-sectioned protrusion 20*f*, (one shown in FIG. 4), extends from each end of the bottom plate 20. The spaced apart protrusions 20*f* of the bottom plate 20 fit into the channel formed by the flanges 11*b* and 11*c* of the wall bracket 11 and the channel formed by the flanges 14*b* and 14*c* of the F-channel cross member 14. In this position, the outside surface 22*b* of web 22 and the upper surface 20*a* of the bottom plate 20 is adjacent to the front side 16*g* of the first roof panel 16 with an intermediate seal 18*b* covering the outer periphery of the first roof panel 16 while the back side 16*f* of the second roof panel 16 is adjacent to the outside surface 23*b* of web 23 and the upper surface 20*a* of bottom plate 20 with a second intermediate seal 18*b* covering the outer periphery of the second roof panel 16. The two roof panels 16 are then secured in place by mating the upper plate 21 with the bottom plate 20 wherein ribs 25*c* and 26*c* of wall 25 and 26 of securing post 24 mate with ledges 27*a* and 27*b* of arrow tab 27, thereby completing the roof channel member 12. As shown in FIG. 1, the roof proper of the preferred awning 10 consists of four roof panels 16 with three intermediate roof channels 12 secured side-by-side between the wall bracket 11 and the F-channel cross member 14 with one F-channel side member 13 positioned on the back side 16*f* of the first roof panel 16 and a second F-channel side member 13 positioned on the front side 16*g* of the fourth roof panel 16.

A rectangular cross-sectioned recess 31 (FIG. 3) is formed in walls 25 and 26 of the securing post 24. Recess 31 consists of a front wall 31*a*, a back wall 31*b*, and a base wall 31*c*. The front wall 31*a* and the back wall 31*b* of recess 31 are spaced apart and formed in wall 25 and wall 26 of securing post 24 perpendicular to the plane a—a of the bottom plate 20. Base wall 31*c* of channel 31 is parallel with and spaced below the base wall 24*b* of channel 24*a* of the securing post 24 so that the base wall 31*c* of channel 31 and the upper surface 20*a* of the bottom plate 20 are coplanar.

An opening 32, centered on the plane a—a, is provided through the base wall 31*c* of recess 31 for mounting a light socket 33 to the bottom plate 20 for receiving a light bulb 34. An annular groove 35 is provided in the lower surface 20*b* of the bottom plate 20 concentric with opening 32. The light socket 33 fits into opening 32 and is held in place by annular rim 33*a* and nut 36 which threads onto the distal end 33*b* of the light socket 33 as shown in FIG. 2. A rectangular cross-sectioned recess 37 (FIG. 3) is formed through light socket 33. The cylindrical shaped light bulb 34 which has a rounded distal end 34*a* and a raised ridge 34*b* with filament wires 34*c* extending from the proximal end 34*d*, snaps into recess 37 at the threaded, distal end 34*b* of light socket 33.

Electrical wires 40 with attached electrical wire connectors 41 are positioned in channels 28 and 29 of bottom plate 20. The electrical wires 40 exit the roof channel 12 through opening 20*g* in bottom plate 20 adjacent to the wall bracket 11. The electrical connectors 41 clamps over the conducting wires 40 and the proximal end 43*a* of J-shaped electrical connectors 43. The distal end 43*b* of two J-shaped electrical connectors 43 are positioned diagonally and on opposite sides of plane a—a in rectangular recess 37 so that filament wires 34*c* of light bulb 34 are in electrical contact with the J-shaped electrical connectors 43, thereby allowing the light bulb 34 to provide lighting to the awning 10. A cap 42 (FIG. 4) snaps onto the wall bracket 11 and covers the electrical wires 40 exiting through opening 20*g* in the bottom plate 20 which is secured to the roof channel 12 through rivets 44.

The roof channels 12 need not necessarily be positioned between two side-by-side roof panels 16. For example, by eliminating side 20*c* of the lower plate 20 and side 21*c* of the upper plate 21 (FIG. 2), the outside surface 22*b* of web 22 will provide for the outside wall of the roof channel 12. In this manner, the roof channel member 12 resembles an F-channel member and can be substituted for the wall bracket 11, the F-channel side members 13, and the F-channel cross member 14 in the channel-braced awning structure 10.

ASSEMBLY

When constructing the preferred channel-braced awning structure 10, the wall bracket 11 is first secured to the outside wall of a building B by bolts 17. The bolts 17 are inserted between the web member 11*a* of the wall bracket 11 and the outside wall of the building B with an intermediate sealing gasket 18*a* to seal against the weather elements The column members 15*a* and 15*b* are then erected spaced apart from the wall bracket 11 a distance to provide for a roof panel 16. The two column members 15*a* are spaced apart from each other a distance sufficient to provide for four side-by-side roof panels 16 with three intermediate roof channel members 12. The column member 15*b* is positioned parallel to the wall bracket 11 and equidistant between the two column members 15*a*.

As shown in FIG. 1, an F-channel cross member 14 is secured across the top of the column members 15*a* and 15*b* by rivets or other suitable fastening means to join the web member 14*a* below the bottom flange 14*c* to the top of the sides of the two column members 15*a* which are parallel to the wall bracket 11 and to the top of the column member 15*b*. A first F-channel side member 13 is next secured between the wall bracket 11 and the F-channel cross member 14. This is done by securing the distal end 13*d* of F-channel side member 13 to the distal end 11*d* of the wall bracket 11 and the proximal end 13*e* of F-channel side member 13 to the distal end 14*d* of the F-channel cross member 14 thereby forming three sides of the frame of the awning 10 so that the roof panels 16 can be mounted.

A first roof panel 16 is slid down the channels formed by the flanges 11*b* and 11*c* of the wall bracket 11 and the flanges 14*b* and 14*c* of the F-channel cross-member 14 until the back side 16*f* of the first roof panel 16 is in the channel formed by flanges 13*b* and 13*c* of the first F-channel side member 13. The roof panel 16 is then framed in place with roof channel member 12. The spaced apart protrusions 20*f* of the bottom plate 20 are fitted into the channels formed by the wall bracket 11 and the F-channel cross member 14. The bottom plate 20 is then slid down the wall bracket 11 and F-channel cross member 14 until the upper surface 20*a* of the bottom plate 20 is underneath the front side 16*g* of the first roof panel 16. In this position, the intermediate seal 18*b* and the outside surface 22*b* of web 22 is adjacent to the front side 16*g* of the first roof panel 16. A second roof panel 16 is then slid down the channels formed by the wall bracket 11 and the F-channel cross member 14 until the back side 16*f* of the second roof panel 16 is adjacent to the outside surface 23*b* of web 23 and the upper surface 20*a* of bottom plate member 20 with a second intermediate seal 18*b* covering the outer periphery of the second roof panel 16. The two roof panels 16 are finally secured in place by mating the upper plate 21 with the bottom plate 20 of the roof channel member 12 so that ribs 25*c* and 26*c* of wall 25 and 26 of securing post 24 mate with ledges 27*a* and 27*b* of arrow tab 27. Glue or a suitable sealing means such as a rubber gasket is used to seal the seam where the upper plate 21 abuts (FIG. 4) with the top flange 11*b* of the wall bracket 11 and the rectangular cross-sectioned protrusion 20*f*.

When four roof panels 16 with intermediate roof channel members 12 have been secured side-by-side between the wall bracket 11 and the F-channel cross member 14, the front side 16*g* of the fourth roof panel 16 is completed by a second F-channel side member 13 so that the front side 16*g* of the fourth roof panel 16 is between the spaced apart flanges 13*b* and 13*c* of the second F-channel side member 13 with an intermediate seal 18*b*. The second F-channel side member 13 is then secured to the column member 15*a* with rivets or other suitable fastening means by joining the vertical web 13*a* of the second F-channel side member 13 below the bottom flange 13*c* to the top of the side of the column member 15*a* that is in a plane perpendicular to the wall bracket 11. The distal end 13*d* of the second F-channel side member 13 is secured to the proximal end 11*e* of the wall bracket 11 (FIG. 1) by rivets or other suitable fastening means. Finally, the proximal end 14*e* of F-channel cross member 14 is secured to the proximal end 13*e* of the second F-channel 13, thereby completing the preferred channel-braced awning structure 10.

Where the back side 16*b* of the four roof panels 16 fit into the spaced apart flanges 11*b* and 11*c* of wall bracket 11, the completed awning 10 is shown as essentially perpendicular (FIG. 4) to web member 11 of wall bracket 11. Actually preferably there is about a ½° downward tilt from horizontal which is accomplished by bending of the panels 16.

The channel-braced awning structure 10 can also be constructed on the ground by securing the four roof panels 16 to the two F-channel side members 13, the F-channel cross member 14, the wall bracket 11, and the roof channel members 12 as explained above. The assembled awning 10 would then be hoisted into the air where it can be secured to the column members 15*a* and 15*b* which have been erected pending installation of the awning 10. Once the two F-channel side members 13 and F-channel cross member 14 have been secured to the column members 15*a* and 15*b* and the wall bracket 11 has been secured to the outside wall of the building B, the column members 15*a* and 15*b* can be permanently anchored in the ground, if this has not already been done.

After the channel-braced awning structure 10 has been built, the channels 28 and 29 of the bottom plate 20 can be opened to expose the electrical wires 40 by first disassembling the F-channel cross member 14 from the first and second F-channel side member 13. The upper plate 21 is then slid down the bottom plate 20 by sliding the lower surface 21*a* of the upper plate 21 away from the wall bracket 11 along a plane perpendicular to the plane a—a and over the upper edges 22*c* of web 22, 23*c* of web 23, 25*d* of wall 25, and 26*d* of wall 26 until the arrow tab 27 of the upper plate 21 releases from the securing post 24 of the bottom plate 20 of the roof channel member 12.

The upper plate 21 can also be designed to release from the bottom plate 20 by inserting a screwdriver or other suitable prying means into the abutment of the upper plate 21 and the top flange 11*b* of the wall bracket 11 (FIG. 4) until the tip of the screwdriver penetrates into either of the channels 28 or 29. The screwdriver is then used to pry the arrow tab 27 from the securing post 24 until the upper plate 21 releases from the bottom plate 20 of the roof channel 12. This latter method may cause some damage to the upper and bottom plates 21 and 20 depending on their materials of construction. For this reason, the former method is preferred for separating the upper plate 21 from the bottom plate 20 to expose the electrical wire 40 in channels 28 and 29.

It is intended that the foregoing description be only illustrative of the present invention and that the present invention be limited only by the hereinafter appended claims.

I claim:

1. An overhang structure which mounts on an outside of a building including a roof panel support provided by multiple spaced apart parallel roof channel members having opposed ends and which roof channel members extend away from the building, F-channel side members at opposed sides of the roof panel support and parallel to the roof channel members, a first F-channel cross member which mounts on an outside wall of the building at one of the ends of the roof channel members and connecting the F-channel side members, and a second F-channel cross member which is parallel to the first F-channel cross member and mounted at the other of the ends of the roof channel members and connecting the F-channel side members and including support members which support the roof support, the improvement which comprises:

(a) each roof channel member having two spaced apart plates and a securing member between and connecting the plates defining at least one channel along a length of the roof channel member, wherein one of the plates of the roof channel member is separable from the securing member to expose two parallel slots inside and along the length of the securing member with a center post along the length of the securing member between the slots, wherein the slots can support separate wires in each slot; and (b) securing means for holding the one of the plates of the roof channel member to the securing member to close the slots, wherein each of the roof channel members supports at least one roof panel along the length of the roof channel member.

2. The structure of claim 1 wherein the center post is provided with a recess along its length which receives a tab member provided on the one of the plates of the roof channel member which hold the one of the plates on the securing member.

3. The structure of claim 3 wherein the recess in the center post is smaller in cross-sectional width adjacent to the one of the plates of the roof channel member than adjacent to the other of the plates of the roof channel member to provide spaced apart lips in the recess and wherein the tab is wider in cross-sectional width at an end which projects into the recess with spaced apart ledges on the tab so that the lips and ledges mate to removably hold the one of the plates to the securing member.

4. The structure of claim 4 wherein the other of the plates has an opening which is adapted to receive a socket for a lightbulb so that the wires in the slots can connect to the socket.

5. The structure of claim 5 wherein the socket is of the type wherein the bulb is mounted by being pressed into spaced apart electrical connectors forming a slot in the socket.

6. The structure of claim 1 wherein the first F-channel cross member is provided with a first gasket means along a length of the F-channel cross member which is mounted between the building and the F-channel cross member.

7. The structure of claim 1 wherein each of the roof panels is formed of parallel spaced apart sheets with support webs between the sheets and wherein the sheets extend between the roof channel members, the F-channel cross members, and the F-channel side members.

8. The structure of claim 1 wherein the roof channel member has a horizontally oriented H-shaped cross-section and supports a roof panel along the length of the roof channel member on opposed portions of the securing member between the side plates.

9. The structure of claim 8 wherein the securing member is provided with a recess along its length which receives a tab member provided on the one of the plates of the roof channel member which hold the one of the plates on the securing member.

10. The structure of claim 9 wherein the recess is smaller in cross-sectional width adjacent to the one of the plates of the roof channel member than adjacent to the other of the side plates of the roof channel member to provide spaced apart lips in the recess and wherein the tab is wider in cross-sectional width at an end which projects into the recess with spaced apart ledges on the tab so that the lips and ledges mate to removably hold the one of the plates to the securing member.

11. The structure of claim 1 wherein each of the roof panels is provided with a gasket means mounted along a perimeter of the roof panel and wherein when the roof panel is mounted on the roof panel support, the gasket means is mounted between the roof panels and the roof channel members, the F-channel side members and the F-channel cross members to provide a weather impervious seal between the roof panels and the roof panel support.

* * * * *

UNITED STATES PATENT AND TRADEMARK OFFICE

CERTIFICATE OF CORRECTION

PATENT NO. : 5,109,643

DATED : May 5, 1992

INVENTOR(S) : George A. Speers

It is certified that error appears in the above-indentified patent and that said Letters Patent is hereby corrected as shown below:

Title page, Column 1 under "U.S. Pat. Documents", "3,332,179 9/1967" should read --3,332,179 7/1967--.

Title page, Abstract, line 11, "member" should be --members--.

Column 1, line 32, "supports" should be --support--.

Column 1, line 51, "wing" should be --wind--.

Column 4, line 19, "plate" should be --plates--.

Column 8, lines 38 and 39, "clamps" should be --clamp--.

UNITED STATES PATENT AND TRADEMARK OFFICE

CERTIFICATE OF CORRECTION

PATENT NO. : 5,109,643

DATED : May 5, 1992

INVENTOR(S) : George A. Speers

It is certified that error appears in the above-indentified patent and that said Letters Patent is hereby corrected as shown below:

Column 9, line 1, a period --.-- should be inserted after "elements" and before "The".

Column 11, Claim 3, line 33, "The structure of Claim 3", should read --The structure of Claim 2--.

Column 11, Claim 4, line 44, "The structure of Claim 4" should read --The structure of Claim 1--.

Column 12, Claim 5, line 3, "The structure of Claim 5" should read --The structure of Claim 4--.

Signed and Sealed this

Third Day of August, 1993

*Attest:*

Michael K. Kirk

MICHAEL K. KIRK

*Attesting Officer*

*Acting Commissioner of Patents and Trademarks*